US007815720B2

(12) United States Patent
McKinney

(10) Patent No.: US 7,815,720 B2
(45) Date of Patent: Oct. 19, 2010

(54) DUAL-FILTER ELECTRICALLY ENHANCED AIR-FILTRATION APPARATUS AND METHOD

(75) Inventor: Peter J. McKinney, Boulder, CO (US)

(73) Assignee: StrionAir, Inc., Louisville, CO (US)

( * ) Notice: Subject to any disclaimer, the term of this patent is extended or adjusted under 35 U.S.C. 154(b) by 345 days.

(21) Appl. No.: 11/771,978

(22) Filed: Jun. 29, 2007

(65) Prior Publication Data

US 2008/0156186 A1 Jul. 3, 2008

Related U.S. Application Data

(60) Provisional application No. 60/882,085, filed on Dec. 27, 2006.

(51) Int. Cl.
*B03C 3/155* (2006.01)
*B03C 3/36* (2006.01)

(52) U.S. Cl. ..... 96/63; 96/66; 96/67; 96/69; 96/76; 96/77; 96/86; 96/96; 96/97

(58) Field of Classification Search ..... 96/66, 96/67, 69, 75–77, 96, 97, 63, 86
See application file for complete search history.

(56) References Cited

U.S. PATENT DOCUMENTS 4,549,887 A * 10/1985 Joannou ..... 96/58
4,781,736 A 11/1988 Cheney
4,828,586 A * 5/1989 Joannou ..... 96/66
4,940,470 A 7/1990 Jaisinghani
5,403,383 A 4/1995 Jaisinghani
5,549,735 A 8/1996 Coppom
5,573,577 A 11/1996 Joannou
5,593,476 A 1/1997 Coppom
5,723,861 A 3/1998 Carnahan
6,077,334 A 6/2000 Joannou
6,491,743 B1 12/2002 Joannou
6,955,708 B1 * 10/2005 Julos et al. ..... 95/59
7,025,806 B2 4/2006 Coppom (Continued)

FOREIGN PATENT DOCUMENTS

DE 19904607 4/2000

(Continued)

OTHER PUBLICATIONS

Agranovski, Igor, Altman, Igor, Grinshpun, Sergey, Hunag, Ruth, Pyankov, Oleg; *Enhancement of the Performance of Low-Efficiency HVAC Filters Due to Continuous Unipolar Ion Emission*; Aerosol Science and Technology, Nov. 1, 2006; pp. 963-968; vol. 40, No. 11.

*Primary Examiner*—Richard L Chiesa
(74) *Attorney, Agent, or Firm*—Miller, Matthias & Hull

(57) ABSTRACT

A dual-filter electrically enhanced air-filtration apparatus and method are described. One embodiment includes an upstream electrically enhanced filter; a downstream electrically enhanced filter; a first control electrode adjacent to an upstream side of the upstream electrically enhanced filter; a second control electrode adjacent to a downstream side of the downstream electrically enhanced filter; and an ionizing electrode disposed between the upstream and downstream electrically enhanced filters, the ionizing electrode having an electrical potential with respect to the first and second control electrodes. Optional field electrodes may be included to enhance the electric fields associated with the upstream and downstream electrically enhanced filters.

18 Claims, 6 Drawing Sheets

U.S. PATENT DOCUMENTS

| | | | | |
|---|---|---|---|---|
| 7,112,238 | B2 * | 9/2006 | Joannou | 96/66 |
| 7,323,146 | B2 * | 1/2008 | Kim et al. | 422/186.06 |
| 2006/0168926 | A1 | 8/2006 | Dawson | |
| 2006/0180023 | A1 | 8/2006 | Coppom | |

FOREIGN PATENT DOCUMENTS

| | | | |
|---|---|---|---|
| EP | 0125379 | A3 | 5/1985 |
| EP | 0114178 | B1 | 11/1986 |
| EP | 1249265 | A1 | 10/2002 |
| EP | 00989901 | B1 | 3/2005 |
| EP | 01025895 | B1 | 12/2005 |
| GB | 00745609 | A | 2/1956 |
| GB | 00901439 | A | 7/1962 |
| WO | PCT/US2007/88560 | | 12/2007 |

* cited by examiner

DUAL-FILTER ELECTRICALLY ENHANCED AIR-FILTRATION APPARATUS AND METHOD

PRIORITY

The present application claims priority to commonly owned and assigned application No. 60/882,085, entitled "Dual-Filter Electrically Enhanced Air Filtration System, Low-Cost Air Flow Sensor, and Ionization Detector for Air Cleaner," filed on Dec. 27, 2006, which is incorporated herein by reference in its entirety.

FIELD OF THE INVENTION

The present invention relates generally to electrically enhanced air filtration. In particular, but not by way of limitation, the present invention relates to electrically enhanced air-filtration apparatuses and methods providing improved efficiency.

BACKGROUND OF THE INVENTION

Air filtration is used in a wide variety of environments such as automobiles, homes, office buildings, and manufacturing facilities. In many cases, filtration systems are used to remove pollutants such as dust, particulates, microorganisms, and toxins from breathing air, although filtration systems and processes may be used to purify manufacturing environments, process gasses, combustion gasses, and the like.

One particular application of air filtration is in heating, ventilation, and air conditioning (HVAC) systems within buildings. HVAC systems comprise a motor and blower that moves air from a supply through ductwork that distributes the air throughout the building spaces. The air supply may be outside air, recirculated air from inside the building, or a mixture of outside and recirculated air. In these kinds of HVAC systems, air-filtration systems are placed in-line with the ductwork to filter out particulates and organisms that are present within the flow of air.

Another common application of air filtration is in standalone room air-filtration systems. Such a system, which may be portable, is placed in a room to purify the air in an area surrounding the air-filtration system.

Though there are several types of air-filtration technologies such as mechanical filters, frictional electrostatic filters, and electret filters, active electrically enhanced air-filtration systems have become increasingly popular because of their high efficiency. One particular type of electrically enhanced filter includes an upstream screen through which air enters the filter, a pre-charging unit downstream from the upstream screen and upstream from the filter medium, an upstream electrode between the pre-charging unit and the upstream side of the filter medium, and a downstream electrode that is in contact with the downstream side of the filter medium. A high-voltage electric field is applied between the pre-charging unit and the downstream electrode.

Such a filter captures particles via three mechanisms. First, the filter medium physically collects particles in the same manner as a mechanical filter. Second, the high-voltage electric field polarizes particles in the air flow and portions of the filter medium itself, causing the polarized particles to be attracted to polarized portions of the filter medium. Third, the pre-charging unit creates a space-charge region made up of ions within the electric field. The ions cause particles passing through the space-charge region to become electrically charged, and the charged particles are attracted to portions of the polarized filter medium having opposite charge.

Though electrically enhanced filters such as that just described are capable of performing high-efficiency air filtration, the upstream screen in such a design provides little filtration and, therefore, little protection of the downstream filter and electrodes. It is thus apparent that there is a need in the art for an improved electrically enhanced air-filtration apparatus and method.

SUMMARY OF THE INVENTION

Illustrative embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents, and alternative constructions that fall within the spirit and scope of the invention as expressed in the claims.

The present invention can provide a dual-filter electrically enhanced air-filtration apparatus and method. One illustrative embodiment is an air-filtration apparatus, comprising an upstream electrically enhanced filter; a downstream electrically enhanced filter; a first control electrode adjacent to an upstream side of the upstream electrically enhanced filter; a second control electrode adjacent to a downstream side of the downstream electrically enhanced filter; and an ionizing electrode disposed between the upstream and downstream electrically enhanced filters, the ionizing electrode having an electrical potential with respect to the first and second control electrodes.

Another illustrative embodiment is an air-filtration system, comprising a filter assembly that includes an upstream electrically enhanced filter; a downstream electrically enhanced filter; a first control electrode adjacent to an upstream side of the upstream electrically enhanced filter; a second control electrode adjacent to a downstream side of the downstream electrically enhanced filter; and an ionizing electrode disposed between the upstream and downstream electrically enhanced filters, the ionizing electrode having an electrical potential with respect to the first and second control electrodes; and a blower configured to cause air to flow through the filter assembly in a downstream direction.

Yet another embodiment is a method for filtering air, the method comprising applying to an air stream an upstream electric field associated with an upstream electrically enhanced filter, the upstream electric field being capable of polarizing particles in the air stream and portions of a filter medium of the upstream electrically enhanced filter; applying to the air stream a downstream electric field associated with a downstream electrically enhanced filter, the downstream electric field being capable of polarizing particles in the air stream and portions of a filter medium of the downstream electrically enhanced filter; and creating, between the upstream and downstream electrically enhanced filters and within the upstream and downstream electric fields, a space-charge region including ions using an ionizing electrode, the space-charge region being capable of imparting electric charge to particles in the air stream and to portions of the filter media of the upstream and downstream electrically enhanced filters.

These and other embodiments are described in further detail herein.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings, wherein:

DETAILED DESCRIPTION

In an illustrative embodiment of the invention, an air-filtration apparatus includes dual electrically enhanced filters to provide excellent particle capture with low differential pressure, resulting in high efficiency. Such a design also provides desirable germicidal capabilities. Additional advantages of a dual-filter design include the flexibility of staged filtration, in which a relatively coarse upstream filter and a relatively fine downstream filter are employed, and greater protection of the downstream filter and electrodes than is provided by the conventional non-electrically-enhanced upstream screen.

Figure 1:
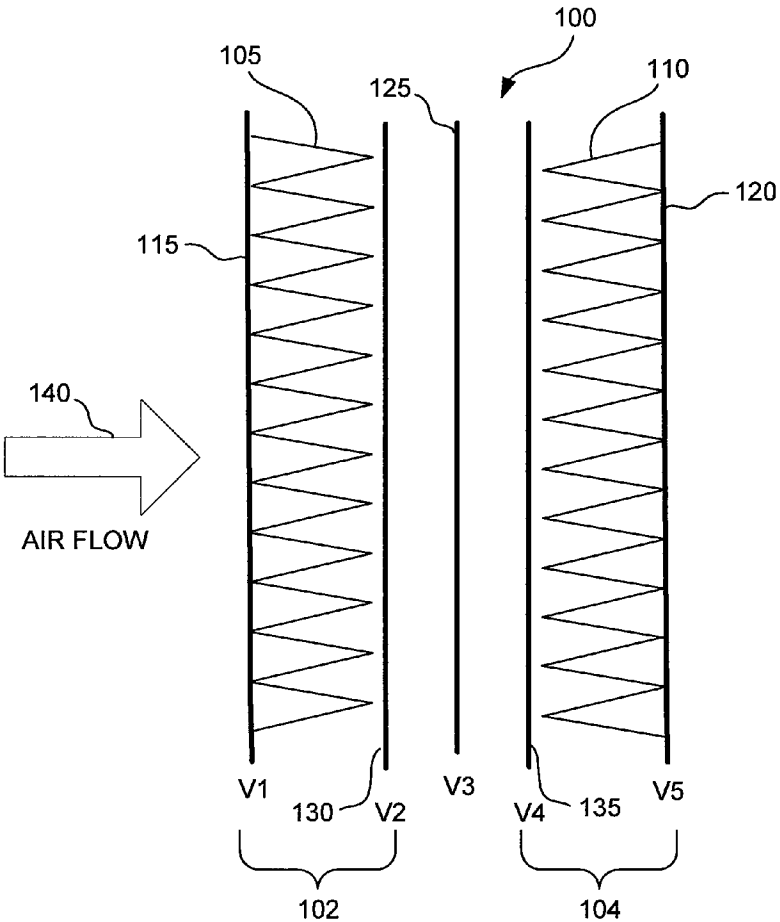
FIG. 1 illustrates an air-filtration apparatus in accordance with an illustrative embodiment of the invention.

Referring now to the drawings, where like or similar elements are designated with identical reference numerals throughout the several views, and referring in particular to FIG. 1, it illustrates an air-filtration apparatus 100 in accordance with an illustrative embodiment of the invention. FIG. 1 is a simplified diagram of air-filtration apparatus 100 as seen from an angle perpendicular to the air flow 140 that flows through air-filtration apparatus 100. Air-filtration apparatus 100 includes upstream electrically enhanced filter 102 and downstream electrically enhanced filter 104. Upstream electrically enhanced filter 102 and downstream electrically enhanced filter 104 include, respectively, upstream filter medium 105 and downstream filter medium 110.

Depending on the particular embodiment, the filter media can be any of a wide variety of available types, and upstream and downstream filter media 105 and 110 may be of the same type or of different types. Examples of different types of filter media include, without limitation, fibrous media, membranous media, sintered metal, and sand. Fibrous filter media are available in a variety of materials and configurations. Fibrous filter media may, for example, be made of some type of felt or other fibrous material and may be woven or non-woven. Also, a fibrous filter medium may be straight or pleated. In one embodiment, at least one of upstream filter medium 105 and downstream filter medium 110 is a fibrous filter medium made from a pleated fabric having a number of substantially parallel pleats. Note that the zigzagging pleats shown in FIG. 1 are merely representative; they are not drawn literally or to scale.

In other embodiments, other types of filter media are employed. For example, in one embodiment, at least one of upstream filter medium 105 and downstream filter medium 110 is a straight filter medium rather than pleated.

Air-filtration apparatus 100 also includes upstream control electrode 115 and downstream control electrode 120. In this embodiment, upstream control electrode 115 is in physical and electrical contact with the upstream side of upstream filter medium 105, and downstream control electrode 120 is in physical and electrical contact with the downstream side of downstream filter medium 110. In a different embodiment, upstream control electrode 115 and downstream control electrode 120 are adjacent to their respective filter media but are not necessarily in physical contact with them. Upstream and downstream control electrodes 115 and 120 may be made of any of a wide variety of relatively conducting materials including, without limitation, perforated metal, expanded metal, electrically conductive paint, a metal screen, and a permeable carbon mat. In embodiments in which upstream and downstream control electrodes 115 and 120 are in physical contact with their respective filter media, upstream and downstream control electrodes 115 and 120 may be in contact with substantially all of a surface of a filter medium, or they may be in contact with only certain portions of a filter medium such as the creases of the pleats of a pleated filter medium. In one embodiment, upstream and downstream control electrodes 115 and 120 have a resistance of about 500,000 ohms per foot.

In some embodiments, upstream filter medium 105 and downstream filter medium 110 are identical or substantially identical. In other embodiments, upstream and downstream filter media 105 and 110 are different. For example, in some embodiments, upstream filter medium 105 is more permeable than downstream filter medium 110. That is, upstream filter medium 105 is a relatively coarse filter, and downstream filter medium 110 is a relatively fine filter. This arrangement provides for staged filtration in which upstream electrically enhanced filter 102 performs a modest degree of filtration that protects downstream filter medium 110 and the electrodes that are downstream from upstream electrically enhanced filter 102.

In the illustrative embodiment of FIG. 1, ionizing electrode 125 is disposed between upstream electrically enhanced filter 102 and downstream electrically enhanced filter 104. In one embodiment, ionizing electrode 125 includes a wire of sufficiently small diameter to induce corona discharge. In another embodiment, ionizing electrode 125 includes an array of sharp points (not shown in FIG. 1), the points being sufficiently sharp to induce corona discharge.

Ionizing electrode 125 produces a space-charge region within the electric fields associated with upstream electrically enhanced filter 102 and downstream electrically enhanced filter 104. This space-charge region is made up of ions, which may be negative or positive, depending on the embodiment. The ions can transfer electric charge to particles that pass through the space-charge region. The electric charge transferred to the particles causes the particles to be attracted to portions of the polarized filter medium having opposite electric charge, resulting in capture of the particles within the filter medium.

Air-filtration apparatus 100 may optionally include upstream field electrode 130 and downstream field electrode 135. Each field electrode 130 or 135 may be insulated or non-insulated. If insulated, the field electrode may be in contact with the filter medium, or it may instead be spaced apart from the filter medium. If non-insulated, the field electrode is spaced apart from the filter medium.

A high-voltage electric field is applied between ionizing electrode 125 and each of the upstream and downstream control electrodes 115 and 120. That is, there is a high-voltage electric field associated with each of the electrically enhanced filters 102 and 104. The electrical potentials of the various elements of air-filtration apparatus 100 are represented in FIG. 1 as V1-V5. Electrically enhanced filters 102 and 104 capture particles and inactivate microorganisms contained in an air flow 140 that flows through air-filtration apparatus 100.

The electrical potentials V1-V5 vary depending on the particular embodiment. In one set of embodiments, negative ionization is employed. In one negative-ionization embodiment, for example, upstream control electrode 115 and downstream control electrode 120 are both at ground potential, ionizing electrode 125 is at −24,000 volts with respect to ground, and both upstream and downstream field electrodes 130 and 135 (if present) are at −12,000 volts (V1=V5=ground, V3=−24,000 volts, V2=V4=−12,000 volts).

In another negative-ionization embodiment, upstream control electrode 115 and downstream control electrode 120 are both at 24,000 volts with respect to ground, ionizing electrode 125 is at ground potential, and both upstream and downstream field electrodes 130 and 135 (if present) are at 12,000 volts (V1=V5=24,000 volts, V3=ground, V2=V4=12,000 volts).

In yet another negative-ionization embodiment, upstream control electrode 115 and downstream control electrode 120 are both at 12,000 volts with respect to ground, ionizing electrode 125 is at −12,000 volts, and both upstream and downstream field electrodes 130 and 135 (if present) are at ground potential (V1=V5=12,000 volts, V3=−12,000 volts, V2=V4=ground).

The particular voltages mentioned above are only illustrative. Other voltages may be employed in other embodiments of the invention.

Those skilled in the art will recognize that a set of positive-ionization embodiments analogous to the above negative-ionization embodiments can be implemented by applying a positive electrical potential instead of a negative electrical potential at ionizing electrode 125 with respect to the upstream and downstream control electrodes 115 and 120.

In general, ionizing electrode 125 has an electrical potential with respect to each of the upstream and downstream control electrodes 115 and 120. Upstream field electrode 130, if included in air-filtration apparatus 100, has an electrical potential between that of ionizing electrode 125 and upstream control electrode 115. Likewise downstream field electrode 135, if included in air-filtration apparatus 100, has an electrical potential between that of ionizing electrode 125 and downstream control electrode 120.

In the embodiments discussed above, the electrical potentials of the various electrodes are symmetrical in the sense that upstream and downstream control electrodes 115 and 120 are at the same electrical potential, and upstream and downstream field electrodes 130 and 135 are at the same electrical potential. Such a symmetrical configuration is not a requirement, however. In some embodiments, upstream and downstream control electrodes 115 and 120 have different electrical potentials, upstream and downstream field electrodes 130 and 135 have different electrical potentials, or both.

In operation, upstream electrically enhanced filter 102 captures particles in air flow 140 through at least two mechanisms: (1) mechanical filtering provided by upstream filter medium 105 and (2) polarization of the particles and portions of upstream filter medium 105. Particles that are not captured by upstream electrically enhanced filter 102 can still become electrically charged as they pass through the ion-rich space-charge region created by ionizing electrode 125. Downstream electrically enhanced filter 104 captures particles in air flow 140 through three mechanisms: (1) mechanical filtering provided by downstream filter medium 110, (2) attraction of particles charged by the ion-rich space-charge region to portions of the polarized downstream filter medium 110 having opposite charge, and (3) polarization of the particles and portions of downstream filter medium 110.

In the illustrative embodiment of FIG. 1, air-filtration apparatus 100 has a planar geometrical structure. In other embodiments, air-filtration apparatus 100 or a portion thereof can have a different geometrical structure. For example, air-filtration apparatus 100 or a portion thereof can have a geometrical structure that is planar, cylindrical, spherical, or a combination of two or more of these. Two illustrative examples are discussed below.

Figure 2:
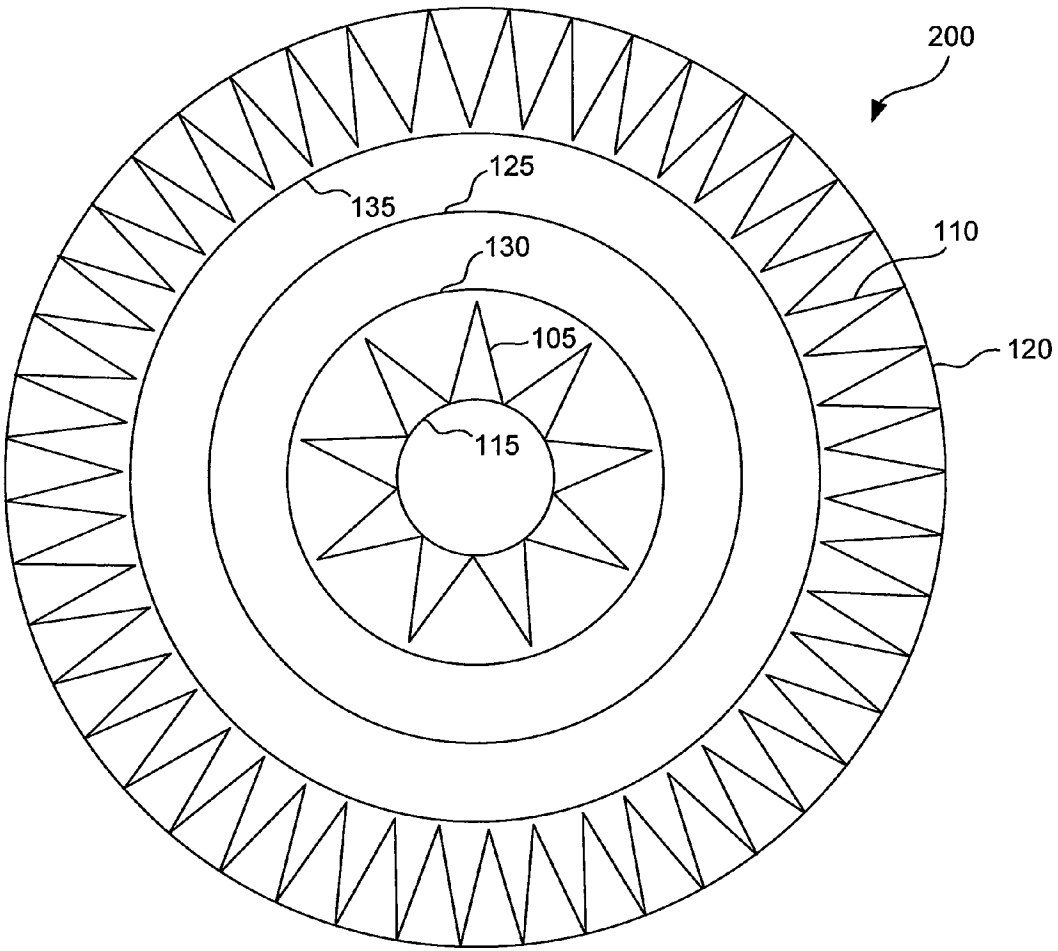
FIG. 2 illustrates an air-filtration apparatus in accordance with another illustrative embodiment of the invention.

FIG. 2 illustrates an air-filtration apparatus 200 in accordance with an illustrative embodiment of the invention. Air-filtration apparatus 200 has a cylindrical structure, and FIG. 2 is a simplified view of air-filtration apparatus 200 from either the top or bottom end of the cylinder. In FIG. 2, the elements of air-filtration apparatus 200 have been given reference numerals identical to those of the corresponding elements shown in FIG. 1 to more clearly indicate the correspondences between the planar and cylindrical designs. In an embodiment such as that shown in FIG. 2, the air flow can occur in one of at least two ways. In some embodiments, air is drawn in through one or both ends of the cylinder (in and/or out of the page in FIG. 2) and is forced out through the sides (walls) of the cylinder. In other embodiments, air is instead drawn in through the sides of the cylinder and pushed out through the open ends.

Figure 3:
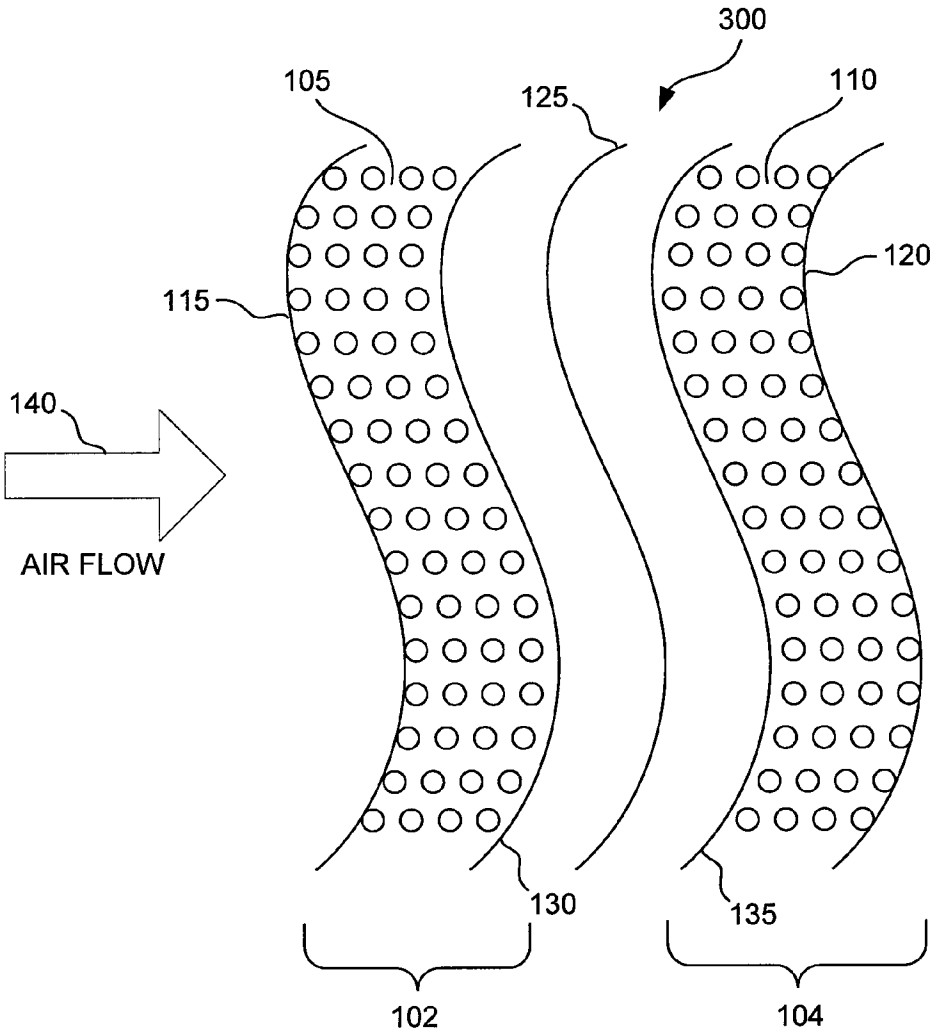
FIG. 3 illustrates an air-filtration apparatus in accordance with yet another illustrative embodiment of the invention.

FIG. 3 illustrates an air-filtration apparatus 300 in accordance with an illustrative embodiment of the invention. Air-filtration apparatus 300, viewed in FIG. 3 from an angle perpendicular to air flow 140 as in FIG. 1, has a curved or "s-shaped" geometrical structure. In FIG. 3, the elements of air-filtration apparatus 300 have been given reference numerals identical to those of the corresponding elements shown in FIG. 1 to more clearly indicate the correspondences between the planar and curved designs. The small circles in FIG. 3 simply represent upstream filter medium 105 and downstream filter medium 110 and are not a literal representation of these filter media.

Many geometrical structures other than the few examples provided above are possible in other embodiments of the invention. For example, in some embodiments, a portion of a sphere (e.g., a hemisphere) may form at least part of the geometrical structure of an air-filtration apparatus.

In each of the illustrative embodiments discussed in connection with FIGS. 1-3, the distance between ionizing electrode 125 and each of the control electrodes (115 and 120) is substantially constant throughout at least a portion of the air-filtration apparatus. This ensures that the desired electric-field properties are consistent throughout that portion of the air-filtration apparatus.

In some embodiments of the invention, at least a portion of an air-filtration apparatus such as air-filtration apparatus 100, 200 or 300 is disposable. In one such embodiment, only the filter media are disposable. In another embodiment, the entire air-filtration apparatus is disposable.

An air-filtration apparatus such as air-filtration apparatus 100, 200, or 300 may be used in a variety of applications. Examples include, without limitation, (1) in the ducts of a home or industrial heating, ventilation, and air conditioning (HVAC) system, (2) next to a forced-air furnace on its inlet side in a home or industrial HVAC system, and (3) in a standalone room air filter. Such a room air filter may, in some embodiments, be portable.

As discussed above, a dual-filter air-filtration apparatus such as air-filtration apparatus 100, 200, or 300 has desirable germicidal properties. The dual electric fields help to ensure that microorganisms are sufficiently dosed with electromagnetic energy to be inactivated while inside the air-filtration apparatus. Such properties can aid the mitigation of, e.g., an influenza pandemic.

Figure 4:
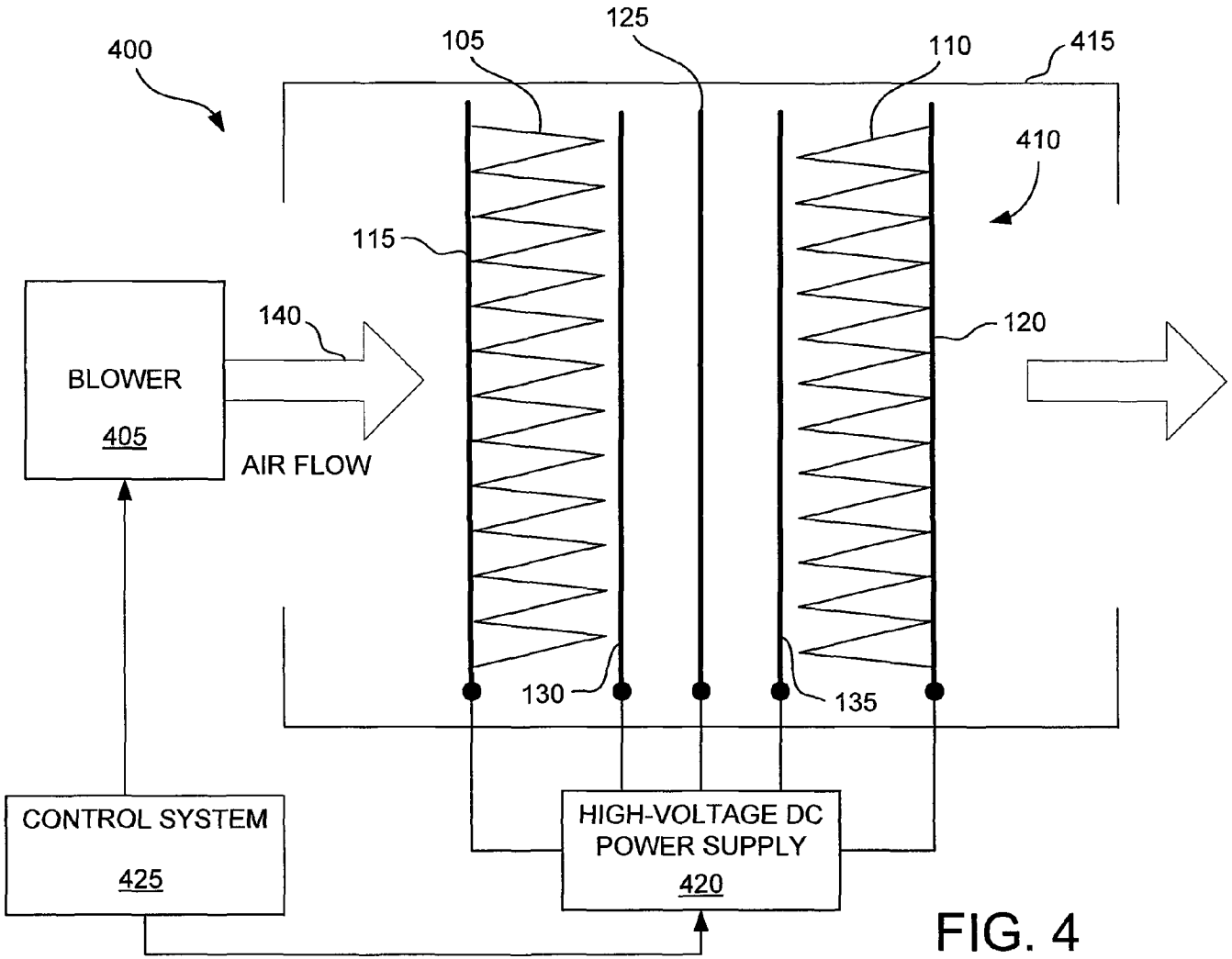
FIG. 4 is a block diagram of an air-filtration system in accordance with an illustrative embodiment of the invention.

FIG. 4 is a block diagram of an air-filtration system 400 in accordance with an illustrative embodiment of the invention. In FIG. 4, a blower 405 causes air flow 140 to flow through filter assembly 410 in a downstream direction. In some embodiments, blower 405 is configured to push air through filter assembly 410. In other embodiments, blower 405 is configured to draw (pull) air through filter assembly 410. Walls 415 represent any structure that is used to direct air flow through filter apparatus 410. In the simplified drawing of FIG. 4, walls 415 are illustrated as being physically spaced from filter assembly 410. However, in practice, walls 415 are typically configured to prevent bypass of air around the edges of filter assembly 410 to ensure that substantially all of air flow 140 passes through filter assembly 410.

High-voltage DC power supply 420 provides the needed electrical potentials to the various filter-assembly electrodes, as discussed above. As pointed out above, one or more of these potentials may be ground, depending on the embodiment. Control system 425 controls the operation of blower 405 and high-voltage DC power supply 420.

Figure 5:
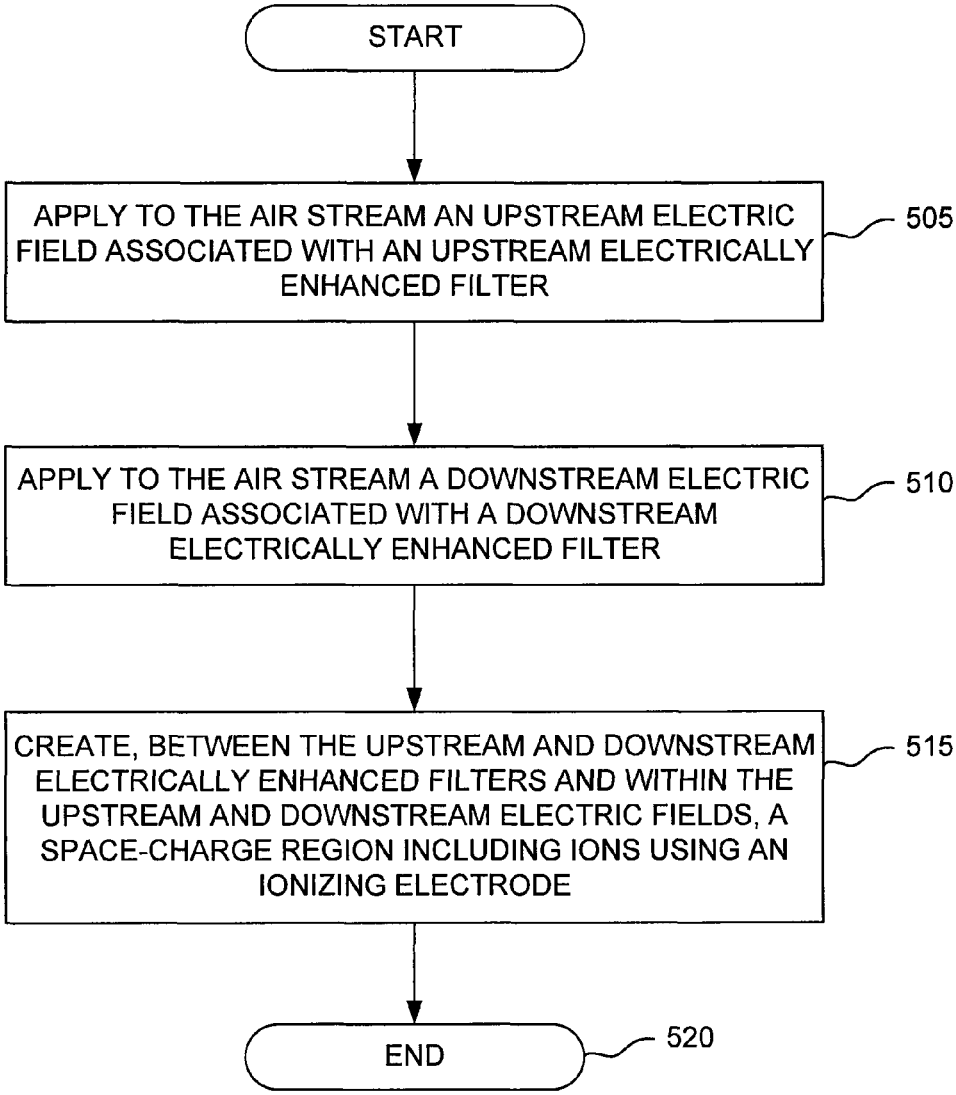
FIG. 5 is a flowchart of a method for filtering air in accordance with an illustrative embodiment of the invention.

FIG. 5 is a flowchart of a method for filtering air in accordance with an illustrative embodiment of the invention. At 505, an upstream electric field associated with upstream electrically enhanced filter 102 is applied to an air stream (e.g., air flow 140). At 510, a downstream electric field associated with downstream electrically enhanced filter 104 is applied to the air stream. As explained above, the upstream and downstream electric fields are capable of polarizing particles in the air stream and portions of the upstream and downstream filter media 105 and 110, respectively. At 520, using ionizing electrode 125, a space-charge region including ions is created between upstream electrically enhanced filter 102 and downstream electrically enhanced filter 104 and within the associated upstream and downstream electric fields. At 520, the process terminates.

Figure 6:
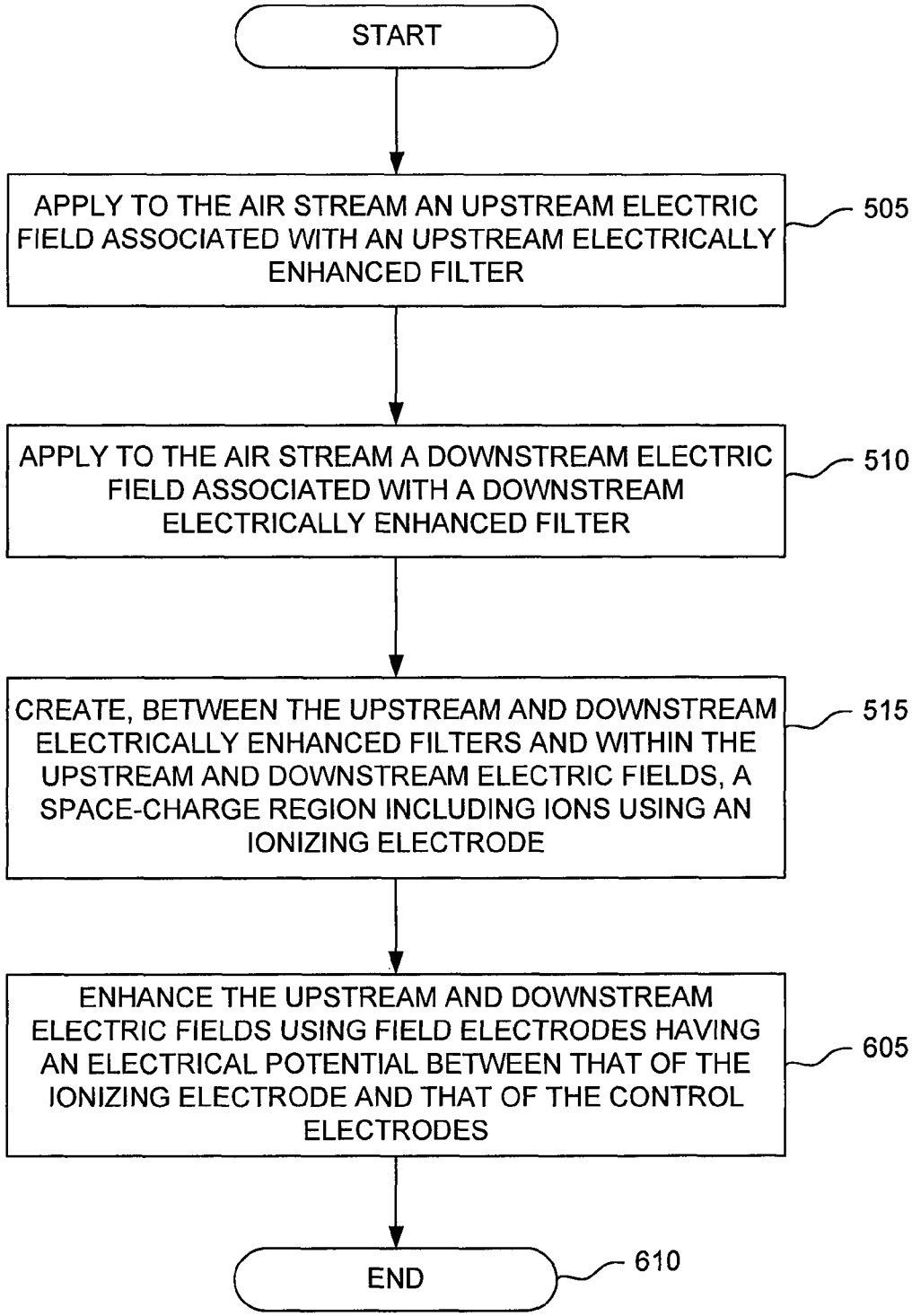
FIG. 6 is a flowchart of a method for filtering air in accordance with another illustrative embodiment of the invention.

FIG. 6 is a flowchart of a method for filtering air in accordance with another illustrative embodiment of the invention. In FIG. 6, the process proceeds as in FIG. 5 through Block 515. At 605, the upstream and downstream electric fields are enhanced through use of upstream and downstream field electrodes 130 and 135, respectively, as described above. At 610, the process terminates.

In conclusion, the present invention provides, among other things, a dual-filter electrically enhanced air-filtration apparatus and method. Those skilled in the art can readily recognize that numerous variations and substitutions may be made in the invention, its use, and its configuration to achieve substantially the same results as achieved by the embodiments described herein. Accordingly, there is no intention to limit the invention to the disclosed illustrative forms. Many variations, modifications, and alternative constructions fall within the scope and spirit of the disclosed invention as expressed in the claims.

What is claimed is:

1. An air-filtration apparatus, comprising:

an upstream electrically enhanced filter;

a downstream electrically enhanced filter;

a first control electrode adjacent to an upstream side of the upstream electrically enhanced filter;

a second control electrode adjacent to a downstream side of the downstream electrically enhanced filter;

an ionizing electrode disposed between the upstream and downstream electrically enhanced filters, the ionizing electrode having an electrical potential with respect to the first and second control electrodes;

a first field electrode disposed between the ionizing electrode and a downstream side of the upstream electrically enhanced filter; and a second field electrode disposed between the ionizing electrode and an upstream side of the downstream electrically enhanced filter;

wherein each of the first and second field electrodes has an electrical potential between that of the ionizing electrode and that of the first and second control electrodes.

2. The air-filtration apparatus of claim 1, wherein at least one of the first and second field electrodes is insulated.

3. The air-filtration apparatus of claim 2, wherein at least one insulated field electrode is in contact with a filter medium of an electrically enhanced filter.

4. The air-filtration apparatus of claim 1, wherein at least one of the first and second field electrodes is not insulated and is not in contact with a filter medium of an electrically enhanced filter.

5. The air-filtration apparatus of claim 1, wherein the electrical potential of the ionizing electrode with respect to the first and second control electrodes is negative.

6. The air-filtration apparatus of claim 1, wherein the electrical potential of the ionizing electrode with respect to the first and second control electrodes is positive.

7. The air-filtration apparatus of claim 1, wherein the upstream and downstream electrically enhanced filters are substantially identical.

8. The air-filtration apparatus of claim 1, wherein the upstream electrically enhanced filter is more permeable than the downstream electrically enhanced filter.

9. The air-filtration apparatus of claim 1, wherein at least one of the upstream and downstream electrically enhanced filters includes a fibrous filter medium.

10. The air-filtration apparatus of claim 9, wherein the fibrous filter medium is a pleated fabric having a plurality of substantially parallel pleats.

11. The air-filtration apparatus of claim 1, wherein at least one of the first and second control electrodes includes one of perforated metal, expanded metal, electrically conductive paint, a metal screen, and a permeable carbon mat.

12. The air-filtration apparatus of claim 1, wherein the ionizing electrode includes a wire of sufficiently small diameter to induce corona discharge.

13. The air-filtration apparatus of claim 1, wherein the ionizing electrode includes an array of points sufficiently sharp to induce corona discharge.

14. The air-filtration apparatus of claim 1, wherein at least a portion of the air-filtration apparatus has a geometrical structure that is one of planar, cylindrical, spherical, and a combination of at least two thereof, the distance between the ionizing electrode and each of the first and second control electrodes being substantially constant throughout the at least a portion of the air-filtration apparatus.

15. The air-filtration apparatus of claim 1, wherein at least a portion of the air-filtration apparatus is disposable.

16. The air-filtration apparatus of claim 1, wherein the air-filtration apparatus is capable of inactivating microorganisms captured by the air-filtration apparatus.

17. The air-filtration apparatus of claim 1, wherein the first control electrode is in physical contact with the upstream side of the upstream electrically enhanced filter and the second control electrode is in physical contact with the downstream side of the downstream electrically enhanced filter.

18. An air-filtration system, comprising:

a filter assembly including:

an upstream electrically enhanced filter;

a downstream electrically enhanced filter;

a first control electrode adjacent to an upstream side of the upstream electrically enhanced filter;

a second control electrode adjacent to a downstream side of the downstream electrically enhanced filter; and an ionizing electrode disposed between the upstream and downstream electrically enhanced filters, the ionizing electrode having an electrical potential with respect to the first and second control electrodes;

a blower configured to cause air to flow through the filter assembly in a downstream direction;

a first field electrode disposed between the ionizing electrode and a downstream side of the upstream electrically enhanced filter; and a second field electrode disposed between the ionizing electrode and an upstream side of the downstream electrically enhanced filter;

wherein each of the first and second field electrodes has an electrical potential between that of the ionizing electrode and that of the first and second control electrodes.

* * * * *